US005172534A

United States Patent [19]

Milner et al.

[11] Patent Number: 5,172,534

[45] Date of Patent: Dec. 22, 1992

[54] CHAINABLE BUILDING BLOCKS

[75] Inventors: Ronald E. Milner, Grass Valley; Eric D. Plambeck, Ventura, both of Calif.

[73] Assignee: ADL Partners, Grass Valley, Calif.

[21] Appl. No.: 679,654

[22] Filed: Apr. 2, 1991

[51] Int. Cl.[5] ..... E04C 1/00; E04C 2/30; A63H 33/06

[52] U.S. Cl. ..... 52/593; 52/578; 446/104; 446/120; 446/128

[58] Field of Search ..... 446/128, 125, 124, 104, 446/120; 52/604, 574, 593, 594, 595, 578

[56] References Cited

U.S. PATENT DOCUMENTS

| | | | |
|---|---|---|---|
| 1,965,601 | 7/1934 | Kotrbaty | 52/593 |
| 2,296,699 | 9/1942 | Bourdelais, Sr. et al. | 52/594 |
| 2,662,335 | 12/1953 | Calverley | 446/120 |
| 3,102,367 | 9/1963 | Pedersen et al. | 52/594 |
| 3,477,167 | 11/1969 | Ach | 446/120 |
| 3,487,579 | 1/1970 | Brettingen | 52/594 |
| 3,605,322 | 9/1971 | Maysubayashi et al. | 52/594 |
| 3,777,393 | 12/1973 | Baer | 446/128 |
| 3,791,091 | 2/1974 | Albrizzi | 52/593 |
| 4,606,732 | 8/1986 | Lyman | 446/120 |
| 4,789,369 | 12/1988 | Lyman | 446/104 |
| 5,049,104 | 9/1991 | Olsen | 446/104 |

*Primary Examiner*—Michael Safavi
*Attorney, Agent, or Firm*—Michael L. Sherrard

[57] ABSTRACT

A construction set is made up of a plurality of detachably chainable links capable of being pivotally attached to one another to form stable geometric structures. Detents are provided at a plurality of pivot positions so as to preferentially hold the engaged links in stable and precise positions relative one to another.

18 Claims, 6 Drawing Sheets

CHAINABLE BUILDING BLOCKS

BACKGROUND OF THE INVENTION

1. Field

The present invention relates to the fields of toys and construction sets. More specifically, the present invention relates to a plurality of detachably chainable links capable of being pivotally attached to one another to form stable geometric structures.

2. Art Background

Interlocking links have been used for toys, electrical connectors, ornamental chains, index chains and chain links. One toy distributed by Matchbox Toys under the LINK·IT trademark included pieces for building a chain or other geometric shape from a number of links. A chain of electrical connectors linked end-to-end in the direction of their length is taught by John C. Collier in U.S. Pat. No. 4,360,969. Ornamental chains and necklaces are taught by H. Becker in U.S. Pat. No. 2,699,035; G. R. S. Charles in U.S. Pat. No. 2,714,269; G. R. S. Charles et al in U.S. Pat. No. 3,066,501; and H. Meyer in U.S. Pat. No. 3,323,325. G. K. Hall teaches a flexible index strip in U.S. Pat. No. 2,805,084. R. D. Johnson teaches a detachable chain link in U.S. Pat. No. 2,618,922. With the exception of the LINK·IT TM product, these chainable links were not intended for use in a children's construction set. However, while the LINK·IT TM product does provide a tactile feel, an audible sound and indexing for certain positions where the links are coupled at angles of zero and plus or minus ninety degrees in one plane, it does not provide tactile feel, an audible sound or indexing when the additional links are coupled to construct a three dimensional structure. Further, no indexing is provided intermediate to the zero and ninety degree positions. Another prior art linkable chain has been distributed under the LEGO TM trademark in association with the arm of a robot. However these links were restricted to the construction of clains in 2 dimensions and had no detents for indexing the angular positions between links.

It is desirable for a construction set to be capable of providing a precise and stable three-dimensional structure. Unfortunately, prior art products are either unstable or incapable of being arranged in arbitrary three-dimensional structure. For example, most of the prior art chainable links are designed to freely rotate or freely pivot between links. The LINK·IT product apparently holds its pivotal position only because of friction between links. This is not sufficient to provide a suitably stable structure. Further, the non-indexed pivotal engagement of the links makes it difficult to align two links in a precise manner. Finally, many prior art chainable links are free to rotate in an unrestricted manner in any direction, such as the ball-and socket stringless necklace beads taught by G. R. S. Charles et al in U.S. Pat. No. 3,066,501. This makes it nearly impossible to build precise geometrical structures. Alternatively, many prior art pivotal links are limited to a single plane.

Accordingly, it is desirable to provide a construction set made up of releaseably attachable chainable links that can form a stable and precise three-dimensional geometric shape. Further, it is desirable that the positions between links be indexed and that a good tactile feel and/or audible feedback be provided when an indexed position is reached.

SUMMARY OF THE INVENTION

A construction set in accordance with the preferred embodiment of the invention is made up of a plurality of detachably chainable links capable of being pivotally attached to one another to form stable geometric structures. Each link has a first u-shaped portion having interior bumps, and a second extension portion configured to pressably engage into the first u-shaped portion. The second extension portion is bumped so as to releaseably and pivotally attach to the corresponding u-shaped portion of other links. Two complementary link geometries provide for building three-dimensional geometric structures. Finally, detents are provided in the pivot positions at multiples of 45° so as to preferentially hold the engaged links in stable and precise positions relative to one another. A tactile feedback and audible click are provided when an indexed position is reached or passed.

These and other advantages and features of the invention will become readily apparent to those skilled in the art after reading the following detailed description of the preferred embodiment of the present invention and studying the accompanying drawings.

DETAILED DESCRIPTION OF THE PREFERRED EMBODIMENT

Figure 1:
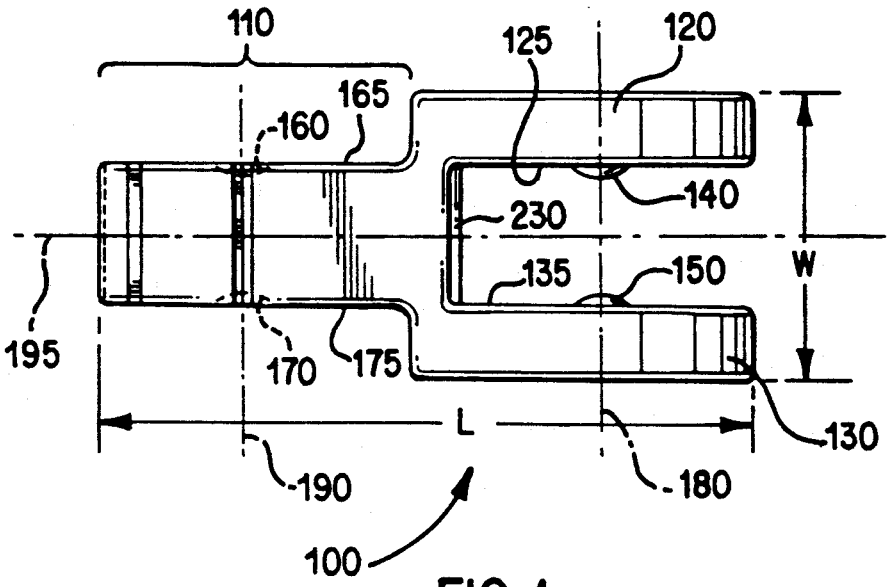
FIG. 1 is a top view of a first modular building block according to the preferred embodiment of the present invention.
Figure 2:
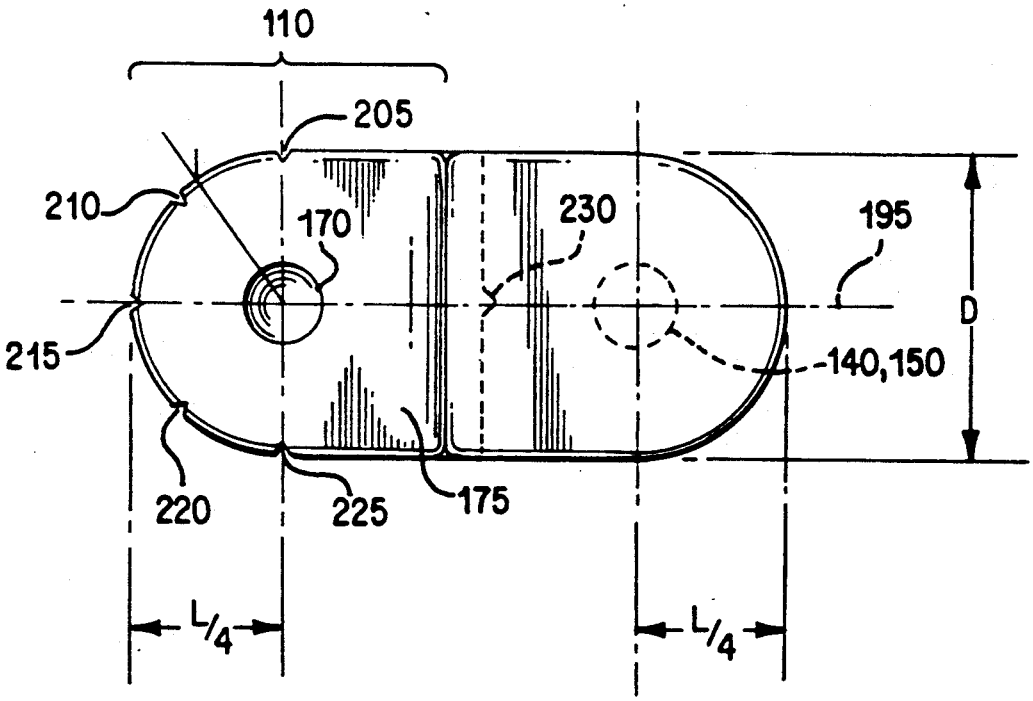
FIG. 2 is a side view of the first modular building block illustrated in FIG. 1.

FIG. 1 is a top view of a first modular building block according to the preferred embodiment of the present invention. FIG. 2 is a side view of the first modular building block illustrated in FIG. 1. Modular building block 100 has a length L of 22 millimeters, a width W of 11 millimeters, and a depth D of 11 millimeters. Depth D is approximately equal to width W, and both depth D and width W are approximately one-half the dimension of length L. Modular building block 100 includes a projection 110 having a length of 11 millimeters, one-half of length L. Projection 110 has a width of approximately 5 millimeters. Modular building block 100 also includes two arms 120 and 130. Arms 120 and 130 are spaced apart by approximately 5 millimeters and adapted to releasably and pivotally attach to the projection of another modular building block.

More specifically, arms 120 and 130 have bumps 140 and 150 on their inward faces 125 and 135 respectively. These bumps have a diameter of 2.54 millimeters, are 0.40 millimeters high and have a radius of approximately 2.31 millimeters. Projection 110 has dimples 160 and 170 on opposite outward faces 165 and 175 respectively positioned to releaseably and pivotally engage with the bumps of another modular building block. Dimples 160 and 170 have dimensions complementary to the dimensions of bumps 140 and 150. Bumps 140 and 150 are aligned along an axis 180 orthogonal to inward faces 125 and 135. Dimples 160 and 170 are aligned along an axis 190 orthogonal to outward faces 165 and 175. Axis 180 is parallel to axis 190, and both axes 180 and 190 are orthogonal to centerline 195 through the length of modular building block 100. Axis 180 is positioned approximately one-quarter of the length L from the nearest end of modular building block 100 along centerline 195. Similarly, axis 190 is positioned approximately one-quarter of length L from the other end of modular building block 100 along centerline 195.

Arms 120 and 130 are radiused about axis 180 at a radius $R_1$ of 5.08 millimeters. Similarly, projection 110 is radiused about the axis 190 at a radius $R_2$ of 5.33 millimeters.

Also illustrated in FIG. 2 are detents 205, 210, 215, 220, and 225 on projection 110. These detents are adapted to releaseably engage with tooth 230 of another modular building block positioned between arms 120 and 130 and illustrated in FIGS. 1 and 2. Specifically, modular building block 100 is constructed of a ABS plastic, which causes arms 120 and 130 to be springy or resilient. As one modular building block pivots relative to another between detent positions, porjection 110 of the one modular building block is pushed slightly away from tooth 230 of the other, causing arms 120 and 130 of the other link to spread. When the building blocks are rotated such that tooth 230 aligns with one of the detents 205, 210, 215, 220, and 225 on projection 110, the resilience of arms 120 and 130 causes tooth 230 to engage the detent and to resist further rotation, releaseably fixing the two modular building blocks in a fixed angular position one-to-another.

A large number of modular building blocks can be releaseably chained to form a stable and precise geometric shape. Specifically, the dimensions and materials of the arms, bumps and dimples have been selected to permit the relatively easy coupling of projection 110 of one modular building block into engagement with the arms of another modular building block by pressing it such that the dimples 160 and 170 of the one block engage with the bumps 140 and 150 of the other block. The two blocks will now be pivotally coupled, pivoting relative to each other about axis 190 of the one modular building block, which is now coincident with axis 180 of the other modular building block.

Further, detents 205–225 of the one modular building block will preferably engage with tooth 230 of the other modular building block such that the two blocks will be stable at specific angles. Specifically, centerlines 195 of the two blocks will be at angles of 0°, ±45° and ±90° when tooth 230 is engaged with a detent, resulting in a precise and stable relationship between the two modular building blocks.

Figure 3:
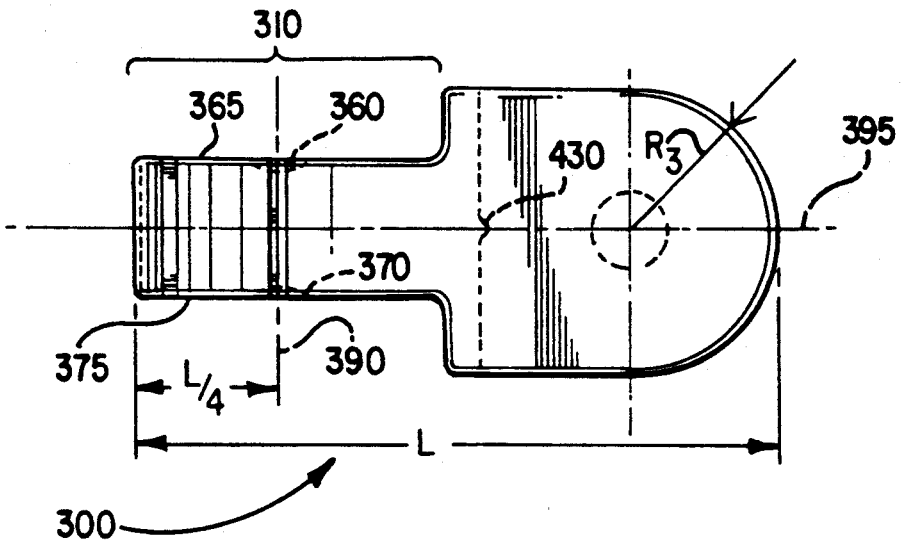
FIG. 3 is a top view of a second modular building block according to the preferred embodiment of the present invention.
Figure 4:
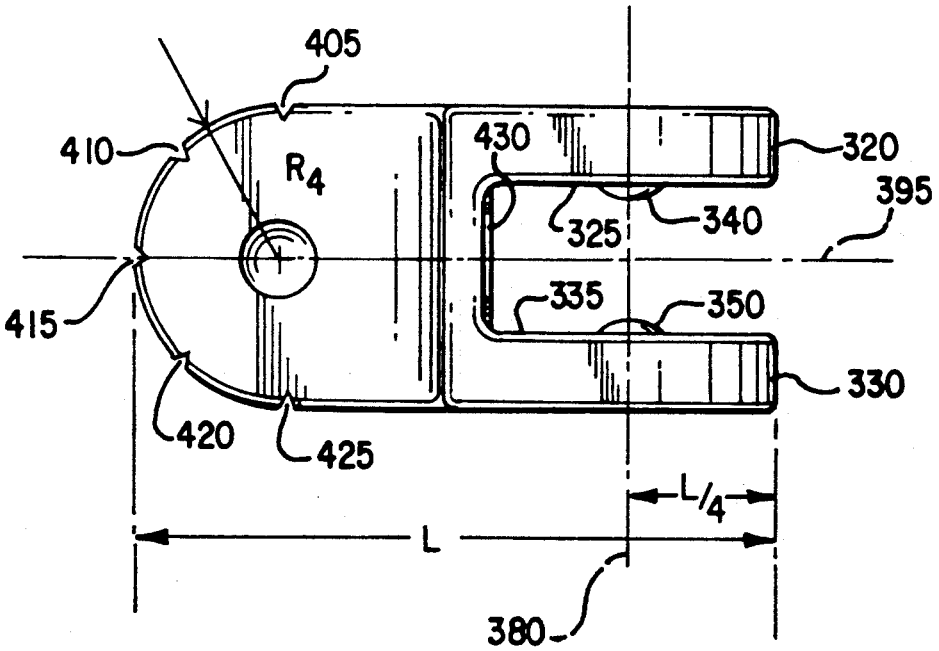
FIG. 4 is a side view of the second modular building block illustrated in FIG. 3.

FIG. 3 is a top view of a second modular building block according to the preferred embodiment of the present invention. FIG. 4 is a side view of the second modular building block of FIG. 3. Modular building block 300 has a length L of 22 millimeters, a width W of 11 millimeters, and a depth D of 11 millimeters. Depth D is approximately equal to width W, and both depth D and width W are approximately one-half the dimension of length L. Modular building block 300 includes a projection 310 having a length of 11 millimeters, one-half of length L. Projection 310 has a width of approximately 5 millimeters. Modular building block 300 also includes two arms 320 and 330. Arms 320 and 330 are spaced apart by approximately 5 millimeters and adapted to releaseably and pivotally attach to projection 310 of another modular building block. More specifically, arms 320 and 330 have bumps 340 and 350 on their inward faces 325 and 335 respectively. These bumps have a diameter of 2.54 millimeters, are 0.40 millimeters high and have a radius of approximately 2.31 millimeters. Projection 310 has dimples 360 and 370 on opposite outward faces 365 and 375 respectively positioned to releaseably and pivotally engage with bumps of another modular building block. Dimples 360 and 370 have dimensions complementary to the dimensions of bumps 340 and 350. Bumps 340 and 350 are aligned along an axis 380 orthogonal to inward faces 325 and 335. Dimples 360 and 370 are aligned along an axis 390 orthogonal to outward faces 365 and 375. Axis 380 is orthogonal to axis 390, and both axes 380 and 390 are orthogonal to centerline 395 through the length of modular building block 300.

As illustrated in FIGS. 3 and 4, axis 380 is positioned approximately one-quarter of length L from the nearest end of modular building block 300 along centerline 395. Similarly, axis 390 is positioned approximately one-quarter of length L from the other end of modular building block 300 along centerline 395. Further, arms 320 and 330 are radiused about axis 380 at a radius $R_3$ of 5.08 millimeters. Similarly, projection 310 is radiused about axis 390 at a radius $R_4$ of 5.33 millimeters.

Also illustrated in FIG. 4 are detents 405, 410, 415, 420, and 425 on projection 310. These detents are adapted to releaseably engage with tooth 430 positioned between arms 320 and 330 and operate in the same manner as described with reference to building block 100 and FIGS. 1 and 2.

The use of two different types of pieces 100 and 300 provides a construction set that can form stable and precise three-dimensional structures such as model houses, people, balls, cars, spaceships and other structures typical of children's construction sets. Further, the preferred embodiment of the present invention provides a good tactile feel and an audible response. More specifically, the preferred embodiment of the present invention provides tactile and audible feedback indicating that a detent position has been engaged. This stimulates the senses, aids the construction of stable structures, and provides the feeling of quality, and precision.

Figure 5:
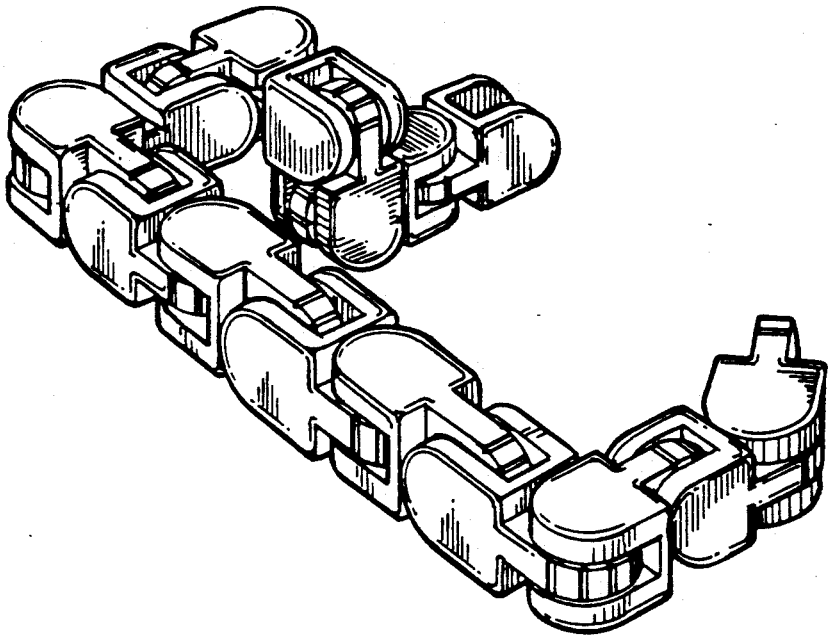
FIG. 5 is a perspective view of a chain of modular building blocks including blocks of the types illustrated in FIGS. 1–4.

FIG. 5 is a perspective view of a chain of modular building blocks including blocks of the type illustrated in FIGS. 1–4. The chain shows the blocks in indexed positions configured in a stable three-dimensional structure.

Figure 6:
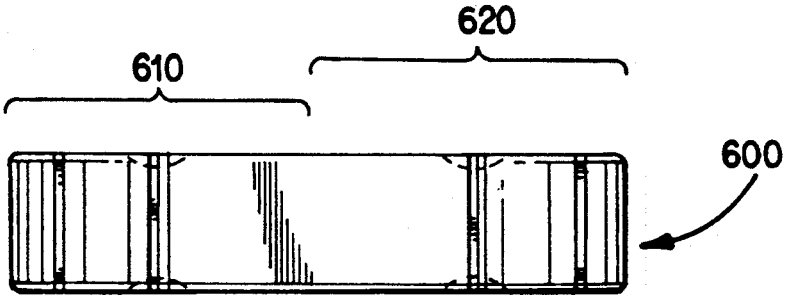
FIG. 6 is a top view of a first modular building block according to an alternative embodiment of the present invention.
Figure 7:
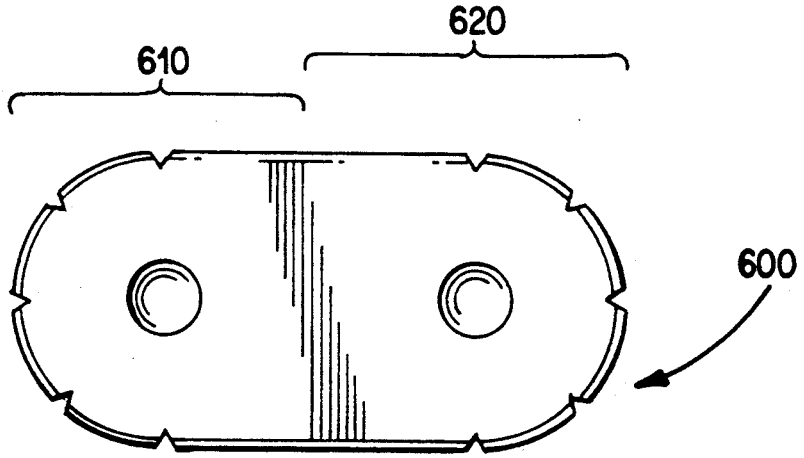
FIG. 7 is a side view of the first modular building block illustrated in FIG. 6.
Figure 8:
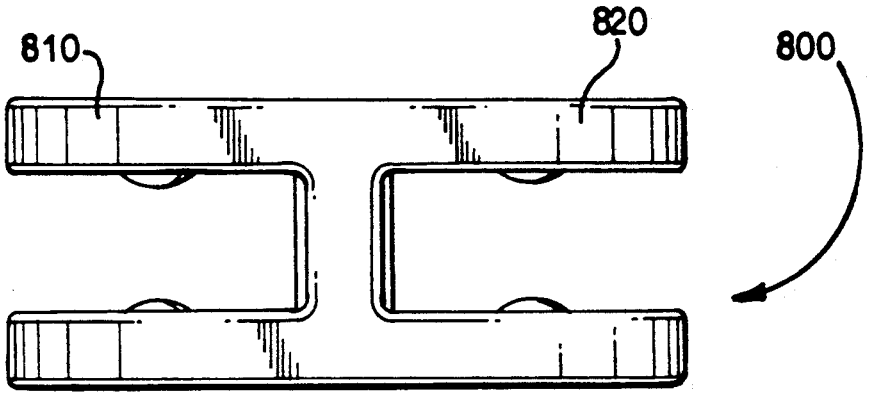
FIG. 8 is a top view of a second modular building block according to an alternative embodiment of the present invention.
Figure 9:
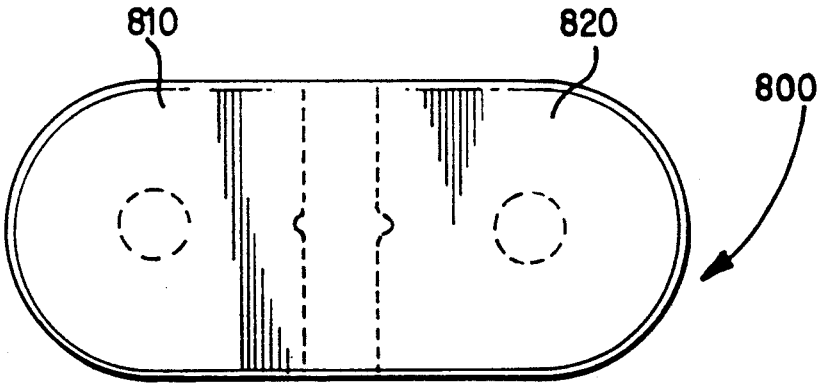
FIG. 9 is a side view of the second modular building block illustrated in FIG. 8.
Figure 10:
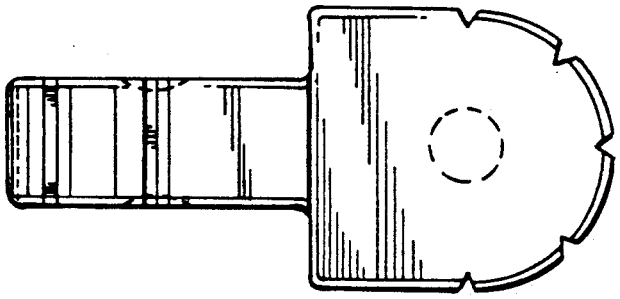
FIG. 10 is a top view of a modular building block according to an alternative embodiment of the present invention.
Figure 11:
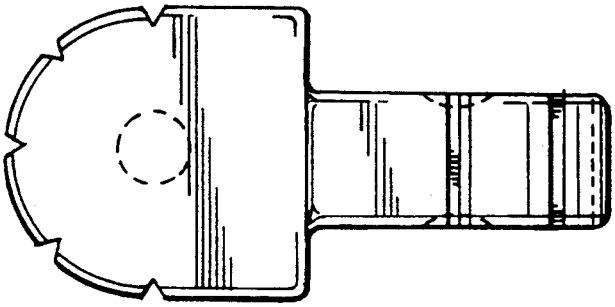
FIG. 11 is a side view of the first modular building block illustrated in FIG. 10.
Figure 12:
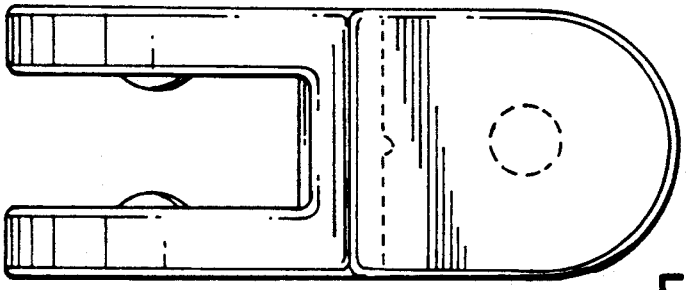
FIG. 12 is a top view of a modular building block according to an alternative embodiment of the present invention.
Figure 13:
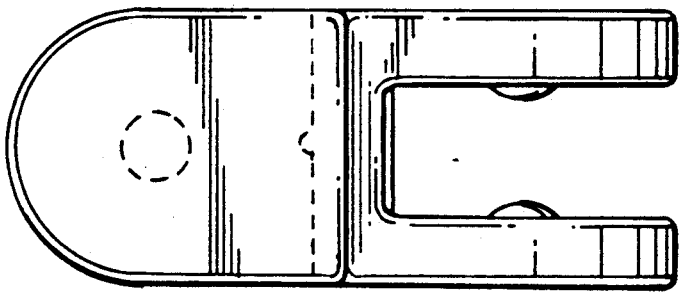
FIG. 13 is a side view of the second modular building block illustrated in FIG. 12.

An alternative embodiment of the present invention is illustrated in FIGS. 6, 7, 8 and 9. A chain according to this embodiment requires alternating links of two types. The first type of link 600 is illustrated in FIGS. 6 and 7 and comprises two projections 610 and 620 fixed end to end. Projections 610 and 620 are configured the same as projection 110 described in detail above with references to FIGS. 1 and 2. The second type of link 800 is illustrated in FIGS. 8 and 9 and comprises two sections 810 and 820 fixed end to end. Sections 810 and 820 are configured the same as the portion of block 100 not including projection 110, as described in detail above with reference to block 100 and FIGS. 1 and 2. These blocks operate the same as blocks 100 and 300, except that blocks will not couple with blocks of the identical type.

In another alternative embodiment illustrated in FIGS. 10–13 of the invention, a link is configured like link 600 except that projection 620 is rotated 90° relative to projection 610. Another link is configured like link 800 except that section 820 is rotated 90° relative to section 810. These links permit the construction of three dimensional structures.

While the invention has been particularly taught and described with reference to the preferred embodiment, those versed in the art will appreciate that minor modifications in form and details may be made without departing from the spirit and scope of the invention. For instance, while the preferred embodiment teaches bumps on the arms and dimples on the projections, these could be reversed. Similarly, other physical geometries could be used for providing the releasable pivoting engagement between links. Further, while the preferred embodiment teaches a single tooth between the arms engaging multiple detents on the projection, multiple teeth could be coupled provided between the arms for engagement with a single detent to provide the same function. Similarly, the tooth and detent positions could be reversed. Accordingly, all such modifications are embodied within the scope of this patent as properly come within my contribution to the art and are particularly pointed out by the following claims.

I claim:

1. A modular building piece adapted to releasably attach to another in a pivoting relationship, the piece comprising: two resilient spaced elements in parallel opposition at a first end providing a cavity therebetween, the cavity facing away from the piece along a centerline between the ends of the piece; a projection at the other end aligned along the centerline adapted to seat in the cavity of another piece; dimples and bumps defining a first axis at the first end and a second axis at the second end, the dimples adapted to pivotally and releasably engage bumps of the other piece about one of the axes, the bumps adapted to pivotally engage the dimples of the other piece about the other axis, and detent means for releasably fixing the piece in a selected one of a plurality of angular positions about one of the axes relative to an attached piece.

2. A modular building piece adapted to releasably attach to another in a pivoting relationship as in claim 1, each piece being approximately twice as long as it is deep or wide, and being approximately as wide as it is deep, the first axis being orthogonal to a centerline through the length of the piece and intersecting the centerline approximately one-quarter of the length of the piece from the one end, the second axis being orthogonal to the centerline and intersecting the centerline approximately one-quarter of the length of the piece from the other end.

3. A construction set comprising two links pivotally connectable in end to end relation, a first link comprising first pivot means at one end thereof defining a first axis and another first pivot means at the other end thereof defining a second axis; a second link comprising second pivot means at one end thereof defining a third axis and another second pivot means at the other end thereof defining a fourth axis; both of the first pivot means of the first link adapted to pivotally and releasably engage either of the second pivot means of the second link such that the axis defined by the engaged first pivot means is coincident with the axis defined by the engaged second pivot means; bias means for biasing the engaged first pivot means of the first link and the engaged second pivot means of the second link into a stable pivoting engagement; the first and second links further comprising detent means for releasably fixing the angular orientation of the first link relative to the second link about the coincident axes in one of a plurality of predetermined angular orientations.

4. A construction set comprising two links pivotally connectable in end to end relation as in claim 3, wherein the angular orientations are spaced apart by integer multiples of 45 degrees about the coincident axes.

5. A construction set comprising two links pivotally connectable in end to end relation as in claim 4, wherein the detent means comprises a plurality of dimples in spaced relation to the first and second axes; and a bump in spaced relation to the third and fourth axes adapted to engage the dimples and positioned so as to releaseably fix the angular orientation of the first link relative to the second link.

6. A construction set comprising two links pivotally connectable in end to end relation as in claim 3, each link being approximately twice as long as it is deep or wide, and being approximately as wide as it is deep, the first axis being orthogonal to a centerline through the length of the link and intersecting the centerline approximately one-quarter of the length of the link from the one end, the second axis being orthogonal to the centerline and intersecting the centerline approximately one-quarter of the length of the link from the other end.

7. A construction set comprising two links pivotally connectable in end to end relation as in claim 6, wherein at least one of the links has the first axis parallel to the second axis.

8. A construction set comprising two links pivotally connectable in end to end relation as in claim 6, wherein at least one of the links has the first axis orthogonal to the second axis.

9. A construction set comprising two links pivotally connectable in end to end relation as in claim 7, wherein at least one of the links has the first axis orthogonal to the second axis.

10. Two modular building pieces adapted to releasably attach one to another in a pivoting relationship, the first piece comprising two spaced elements at two opposing ends thereof providing a cavity therebetween; the second piece comprising a projection at two ends thereof adapted to seat in a cavity of the first piece; dimples on one piece and bumps on the other piece defining a first axis at one end of the first piece and a second axis at one end of the second piece, the dimples on the one piece adapted to pivotally and releasably engage the bumps of the other piece when the first axis is conicident with the second axis, the two pieces further comprising means for releasably fixing the first piece in a selected one of a plurality of angular positions about the coincident axes relative to the second piece.

11. A modular building piece adapted to releaseably attach to another in a pivoting relationship as in claim 10, each piece being approximately twice as long as it is deep or wide, and being approximately as wide as it is deep, the first axis being orthogonal to a centerline through the length of the piece and intersecting the centerline approximately one-quarter of the length of the piece from the one end, the second axis being orthogonal to the centerline and intersecting the centerline approximately one-quarter of the length of the piece from the other end.

12. Two modular building pieces as in claim 10 wherein the cavities of the first piece are orthogonal to one another.

13. Two modular building pieces as in claim 11 wherein the projections of the second piece are orthogonal to one another.

14. A construction set comprising a plurality of links pivotally connectable in end to end relation, each link comprising: first pivot means at one end thereof defining a first axis; second pivot means at the other end thereof defining a second axis, the second pivot means adapted to pivotally and releasably engage the first pivot means of a second link such that the second axis is coincident with the first axis of the second link; and detent means for releasably fixing the angular orientation of the second link about the second axis in one of a plurality of angular orientations; each link being approximately twice as long as it is deep or wide, and being approximately as wide as it is deep, the first axis being orthogonal to a centerline through the length of the link and intersecting the centerline approximately one-quarter of the length of the link from the one end, the second axis being orthogonal to the centerline and intersecting the centerline approximately one-quarter of the length of the link from the other end; wherein at least one of the links has the first axis orthogonal to the second axis.

15. A construction set comprising two links pivotally connectable in end to end relation, a first link comprising first pivot means at one end thereof defining a first axis and another first pivot means at the other end thereof defining a second axis; a second link comprising second pivot means at one end thereof defining a third axis and another second pivot means at the other end thereof defining a fourth axis; both of the first pivot means of the first link adapted to pivotally and releasably engage either of the second pivot means of the second link such that the axis defined by the engaged first pivot means is coincident with the axis defined by the engaged second pivot means; the first and second links further comprising detent means for releasably fixing the angular orientation of the first link relative to the second link about the coincident axes in one of a plurality of predetermined angular orientations; each link being approximately twice as long as it is deep or wide, and being approximately as wide as it is deep, the first axis being orthogonal to a centerline through the length of the link and intersecting the centerline approximately one-quarter of the length of the link from the one end, the second axis being orthogonal to the centerline and intersecting the centerline approximately one-quarter of the length of the link from the other end; wherein at least one of the links has the first axis parallel to the second axis; wherein at least one of the links has the first axis orthogonal to the second axis.

16. A construction set comprising two links pivotally connectable in end to end relation, a first link comprising first pivot means at one end thereof defining a first axis and another first pivot means at the other end thereof defining a second axis; a second link comprising second pivot means at one end thereof defining a third axis and another second pivot means at the other end thereof defining a fourth axis; both of the first pivot means of the first link adapted to pivotally and releasably engage either of the second pivot means of the second link such that the axis defined by the engaged first pivot means is coincident with the axis defined by the engaged second pivot means; the first and second links further comprising detent means for releasably fixing the angular orientation of the first link relative to the second link about the coincident axies in one of a plurality of predetermined angular orientations; each link being approximately twice as long as it is deep or wide, and being approximately as wide as it is deep, the first axis being orthogonal to a centerline through the length of the link and intersecting the centerline approximately one-quarter of the length of the link from the one end, the second axis being orthogonal to the centerline and intersecting the centerline approximately one-quarter of the length of the link from the other end; wherein at least one of the links has the first axis orthogonal to the second axis.

17. A construction set comprising a plurality of links pivotally connectable in end to end relation, each link comprising: first pivot means at one end thereof defining a first axis; second pivot means at the other end thereof defining a second axis, the second pivot means adapted to pivotally and releasably engage the first pivot means of a second link such that the second axis is coincident with the first axis of the second link; and detent means for releasably fixing the angular orientation of the second link about the second axis in one of a plurality of angular orientations; wherein at least one of the links has the first axis orthogonal to the second axis.

18. A construction set comprising two links pivotally connectable in end to end relation, a first link comprising first pivot means at one end thereof defining a first axis and another first pivot means at the other end thereof defining a second axis; a second link comprising second pivot means at one end thereof defining a third axis and another second pivot means at the other end thereof defining a fourth axis; both of the first pivot means of the first link adapted to pivotally and releasably engage either of the second pivot means of the second link such that the axis defined by the engaged first pivot means is coincident with the axis defined by the engaged second pivot means; the first and second links further comprising detent means for releasably fixing the angular orientation of the first link relative to the second link about the coincident axes in one of a plurality of predetermined angular orientations; wherein at least one of the links has the first axis orthogonal to the second axis.

* * * * *